US010300312B2

(12) United States Patent
Sibuet

(10) Patent No.: US 10,300,312 B2
(45) Date of Patent: May 28, 2019

(54) REGULATOR ASSEMBLY FOR BREATHING MASK

(71) Applicant: Zodiac Aerotechnics, Plaisir (FR)

(72) Inventor: Jean-Philippe Sibuet, Verneuil sur Seine (FR)

(73) Assignee: Zodiac Aerotechnics, Plaisir (FR)

( * ) Notice: Subject to any disclaimer, the term of this patent is extended or adjusted under 35 U.S.C. 154(b) by 687 days.

(21) Appl. No.: 14/694,074

(22) Filed: Apr. 23, 2015

(65) Prior Publication Data

US 2015/0306431 A1 Oct. 29, 2015

(30) Foreign Application Priority Data

Apr. 24, 2014 (FR) ..... 14 53718

(51) Int. Cl.
*A62B 18/02* (2006.01)
*A62B 7/14* (2006.01)

(52) U.S. Cl.
CPC ..... *A62B 7/14* (2013.01); *A62B 18/02* (2013.01)

(58) Field of Classification Search
CPC .. A62B 7/14; A62B 18/02; A62B 7/00; A62B 7/02; A62B 7/10; A62B 7/12; A61M 16/00; A61M 16/021; A61M 16/022
See application file for complete search history.

(56) References Cited

U.S. PATENT DOCUMENTS

| | | | | |
|---|---|---|---|---|
| 2,378,468 | A * | 6/1945 | Deming | A62B 9/022 128/204.26 |
| 3,526,239 | A | 9/1970 | Oroza | |
| 4,928,682 | A | 5/1990 | Stevenson et al. | |
| 5,913,307 | A | 6/1999 | Taieb et al. | |
| 6,470,887 | B1 | 10/2002 | Martinez | |
| 2010/0065061 | A1 | 3/2010 | Aubonnet et al. | |
| 2011/0158421 | A1* | 6/2011 | Voix | A61F 11/08 381/72 |

FOREIGN PATENT DOCUMENTS

| | | | |
|---|---|---|---|
| FR | 2752383 | A1 | 2/1998 |
| WO | 2012038774 | A2 | 3/2012 |
| WO | 2012066394 | A2 | 5/2012 |
| WO | 2013064856 | A1 | 5/2013 |

OTHER PUBLICATIONS

French Patent Application No. 1453718, Search Report dated Dec. 11, 2014.

* cited by examiner

*Primary Examiner* — Timothy A Stanis
(74) *Attorney, Agent, or Firm* — Kilpatrick Townsend & Stockton LLP; Dean W. Russell

(57) ABSTRACT

Regulator assemblies for breathing masks of aircraft crewmembers are described, with such an assembly including a mode selection knob mounted on a support. The knob is movable between at least two positions, allowing an associated regulator to operate in at least two modes of supplying breathing gas to a crewmember. One or more protrusions of the knob, when contacted by fingers of the crewmember, may bias the knob toward a particular one of the at least two positions.

17 Claims, 10 Drawing Sheets

REGULATOR ASSEMBLY FOR BREATHING MASK

CROSS REFERENCE TO RELATED APPLICATION

This application claims priority to French Patent Application No. 1453718 filed Apr. 24, 2014, the entire contents of which are hereby incorporated by reference.

FIELD OF THE DISCLOSURE

The invention relates to a regulator assembly for a breathing mask to be used an aircraft crew member.

BACKGROUND OF THE DISCLOSURE

In a known manner, such a regulator assembly of this type comprises:

- a casing forming a support,
- a mode selection knob mounted on the support so as to be movable between at least a first position and a second position,
- a regulator intended to be supplied by a source of breathing gas and adapted to supply breathing gas to a breathing cavity in at least the following two operating modes:
  - when the mode selection knob is in said first position, the regulator supplies gas to the breathing cavity as long as the pressure in the breathing cavity is not greater than a first pressure relative to ambient pressure,
  - when the mode selection knob is in said second position, the regulator supplies gas to the breathing cavity as long the pressure in the breathing cavity is not greater than a second pressure relative to ambient pressure, the first pressure being greater than the second pressure.

The different positions of the mode selection knob correspond to different operating modes of the regulator that are adopted according to circumstances. The user, typically a pilot, co-pilot, or flight engineer, must manually select the appropriate mode for the circumstances.

When the mode selection knob is in the first position, the regulator supplies the user, via the breathing cavity, with undiluted breathing gas (typically almost pure oxygen) that is pressurized relative to the ambient air of the cockpit. This position is the most suitable for critical situations. It is usually referred to as the "emergency" position and protects the user of the breathing mask from the harmful effects of toxic fumes due for example to a fire in the cockpit.

There are generally other operating modes of the regulator, to reduce the user fatigue caused by the fact that the breathing gas is supplied at a relatively high pressure compared with ambient air, and/or to reduce breathing gas consumption.

Although the known regulator assemblies are satisfactory and provide a good level of safety, the invention aims to further improve the safety they provide.

SUMMARY OF THE DISCLOSURE

To overcome the above problems, according to the invention the mode selection knob comprises at least one protruding portion prompting the user to place the mode selection knob in the first position.

It is apparent with the prior art that the user could detect the position of the mode selection knob, in particular due to labeling on the mode selection knob. Therefore, in a first step the user determined the position of the mode selection knob (for example by looking at the knob labeling or from memory), in a second step the user had to think to determine in which direction to move the mode selection knob, and in a third step the user moved the knob. As these three steps occurred in quick succession, this procedure seemed satisfactory.

However, it is apparent that with the invention, to more quickly place the mode selection knob in the first position or leave it there, the user does not necessarily need to know the current position of the mode selection knob. It is thus apparent that by providing the mode selection knob with a protruding portion prompting the user to move the mode selection knob to the first position, preferably on the basis of tactile prompts such as the shape and/or position of the protruding portion, the user does not need to perform the two preceding steps.

In case of a sudden emergency, the user therefore moves the mode selection knob more quickly into the first position, which improves safety, and the user does not need to see to place the mode selection knob in the first position. It is of course possible that the user will take a little more time placing the mode selection knob in the second position, when this is necessary. However, a slight loss of time in such a situation does not have significant consequences on safety, particularly in comparison to what is gained for emergency situations.

According to another characteristic of the invention, the mode selection knob is preferably mounted to rotate about an axis of rotation extending in one direction.

In a complementary manner, in accordance with the invention, the regulator assembly preferably has the following characteristics:

- the support has an adjacent area offset from the protruding portion in the direction of the axis of rotation and in immediate proximity to the mode selection knob,
- in the second position of the mode selection knob, the protruding portion of the mode selection knob protrudes, relative to the adjacent area of the support, radially to the axis of rotation, and
- when moving from the second position to the first position, the protruding portion of the mode selection knob is moved toward said adjacent area of the support.

Thus, the user is naturally encouraged to move the mode selection knob toward the first position rather than toward the second position.

According to an additional characteristic of the invention, the protruding portion of the mode selection knob is preferably flush with the adjacent area of the support in the first position.

Thus, the user positioning his or her finger in the direction of the axis of rotation will detect the first position by the finger being in contact with both the protruding portion of the mode selection knob and the adjacent area of the support.

According to a further complementary characteristic of the invention, in the first position, the protruding portion of the mode selection knob lies preferably substantially as an extension of the adjacent area of the support for a length of at least 1 centimeter, perpendicular to the axis of rotation.

Thus the first position is particularly distinctive to the user.

In a complementary manner, in accordance with the invention, the regulator assembly preferably has the following characteristics:

the mode selection knob comprises a third position, the first position being located between the second position and the third position, the mode selection knob comprises a second protruding portion and the support has a second adjacent area offset from the second protruding portion in the direction of the axis of rotation and in immediate proximity to the mode selection knob, in the third position of the mode selection knob, the second protruding portion of the mode selection knob protrudes relative to the second adjacent area of the support, radially to the axis of rotation, when moving from the third position to the first position, the second protruding portion of the mode selection knob is moved toward said second adjacent area of the support, and in the first position of the mode selection knob, preferably the second protruding portion of the mode selection knob is flush with the second adjacent area of the support.

Thus, the user is encouraged to set the mode selection knob in the first position, both when starting from the second position and when starting from the third position, although it must be rotated in two opposite directions depending on whether the mode selection knob is in the second position or the third position.

According to an alternative characteristic of the invention, preferably the mode selection knob comprises a third position, the second position being located between the third position and the first position.

In a complementary manner, in accordance with the invention, the regulator assembly preferably has the following characteristics:

the mode selection knob comprises a second protruding portion and the support has a second adjacent area offset from the second protruding portion of the mode selection knob in the direction of the axis of rotation and in immediate proximity to the mode selection knob, in the third position of the mode selection knob, the second protruding portion of the mode selection knob protrudes relative to the second adjacent area of the support, radially to the axis of rotation, when moving from the third position to the second position, the second protruding portion of the mode selection knob is moved toward said second adjacent area of the support, and in the second position of the mode selection knob, preferably the second protruding portion of the mode selection knob is flush with the second adjacent area of the support.

The user is thus naturally encouraged to move the mode selection knob from the third position to the second position and from the second position to the first position, while preferably being able to easily identify the second position.

Furthermore, according to the invention, the regulator assembly preferably has the following characteristics:

the mode selection knob comprises a pair of protruding portions including a first protruding portion and a second protruding portion, diametrically opposed relative to the axis of rotation, and the first protruding portion and the second protruding portion of the mode selection knob respectively have a first support surface and a second support surface, each extending substantially radially to the axis of rotation and such that a force exerted on one or the other of the first support surface and second support surface in the direction of the axis of rotation rotates the mode selection knob from the second position to the first position.

Thus, the act of pinching the mode selection knob between the thumb and index finger, which respectively press against the first support surface and the second support surface, moves the mode selection knob to the first position. The user can thus very quickly set the mode selection knob in the first position without error.

According to an additional characteristic of the invention, preferably the first support surface and second support surface are each concave and preferably smooth.

This facilitates the movement of the mode selection knob to the first position. Smooth is understood to mean that the fingers of the user can easily slide over the support surface, at least perpendicularly to the axis of rotation.

BRIEF DESCRIPTION OF THE DRAWINGS

Other features and advantages of the invention will become apparent in the following detailed description, referring to the accompanying drawings in which.

DETAILED DESCRIPTION

Figure 1:
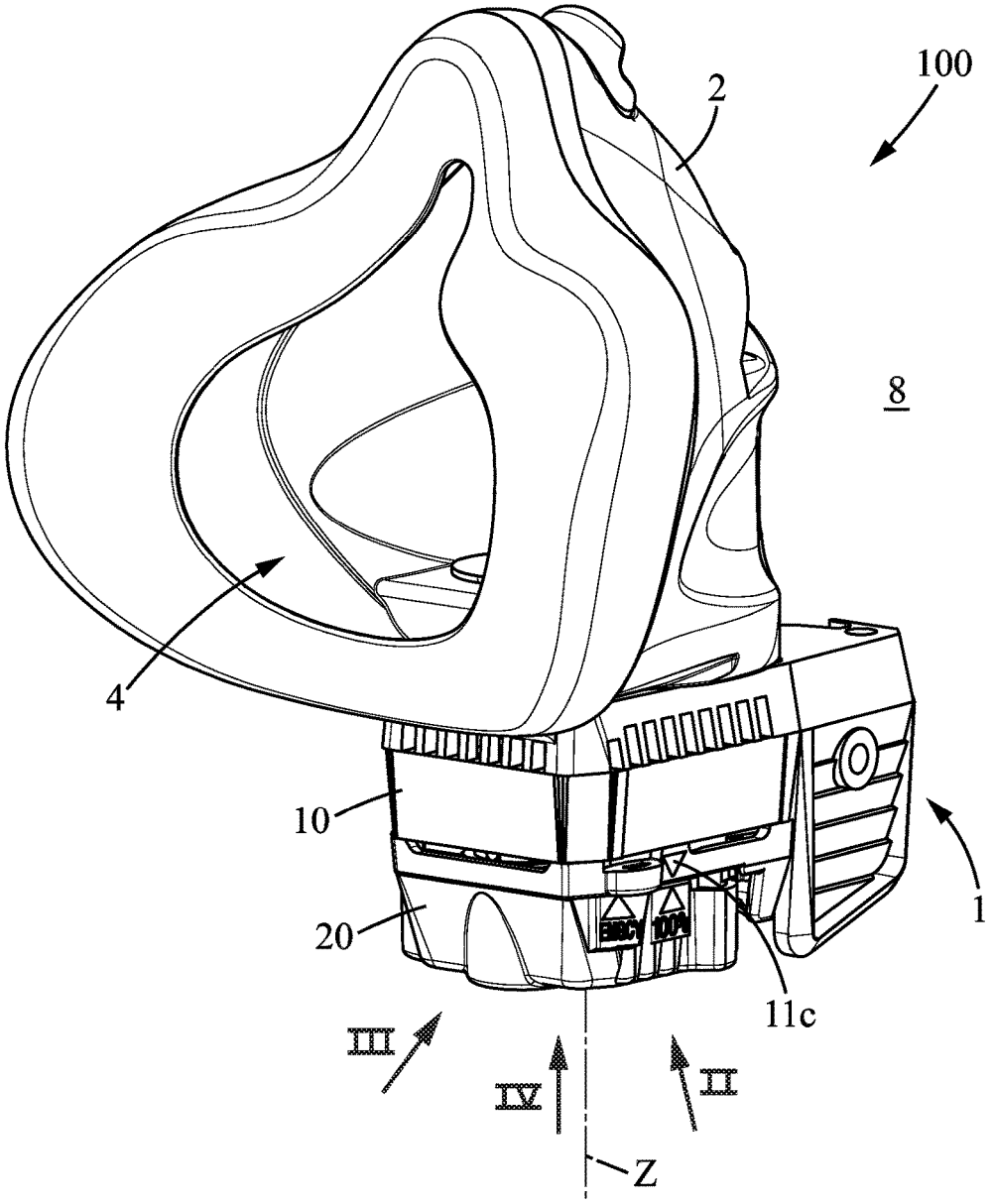
FIG. 1 shows a perspective view of a regulator assembly according to the invention.

The figures show a breathing mask 100 provided in a pressurized cabin 8 of a commercial aircraft for transporting crew and typically passengers as well.

A device, preferably of the isobaric type, pressurizes the cabin so that it does not become lower than a pressurization pressure, generally corresponding to an altitude of between 1500 meters and 2400 meters. As the aircraft rises, the pressure in the cabin is substantially equal to the pressure outside the cabin and reduces, until said pressurization pressure is reached. Under normal conditions, the cabin pressure is then kept constant until the external pressure becomes lower than the pressurization pressure. The breathing mask is designed to allow the user to have enough oxygen and to protect the user from harmful substances in case of incidents such as depressurization and/or the presence of toxic gases or similar events, preventing the cabin occupants from breathing normally.

The breathing mask 100 comprises a regulator assembly 1 and an oronasal facepiece 2 for covering the nose and mouth. The oronasal facepiece is intended to be applied in a substantially sealing manner to the face of a user around the nose and mouth. The oronasal facepiece 2 has a breathing cavity 4 where the user breathes.

The regulator assembly 1 comprises a support 10, a mode selection knob 20, and a regulator. In the embodiments illustrated, the support 10 is in the form of a housing in which the regulator is arranged. The support 10 has a breathing gas supply hole 6, intended for receiving the end of a hose connecting the regulator to a source of breathing gas mainly containing oxygen.

As is well known, the regulator includes three modes of operation. In the first mode of operation, called "emergency" mode, the regulator supplies the breathing cavity 4 with only breathing gas until a slight overpressure is obtained in the breathing cavity 4 relative to the ambient pressure of the cabin air, this pressure generally being between 3 mbar and 30 mbar. In the most common pressure values, between 3 to 7 mbar, this overpressure is barely felt by the user. Beyond 10 to 12 mbar, the overpressure requires substantial additional effort for the user to breathe, which is quickly felt by the user.

In the second mode of operation, called "100%" mode, the regulator supplies the breathing cavity 4 with only breathing gas until the ambient pressure is substantially reached. In practice, it is generally useful to stop the supply to the breathing cavity before the breathing cavity reaches ambient pressure, so that there is a very slight underpressure (a few tenths of an mbar to a few mbar) in the breathing cavity 4.

The third breathing mode, called "normal" mode, differs from the second breathing mode in that the breathing cavity 4 is supplied with breathing gas diluted with air, usually ambient air, in a proportion which is usually a function of the pressure in the cabin 8.

Figure 2A:
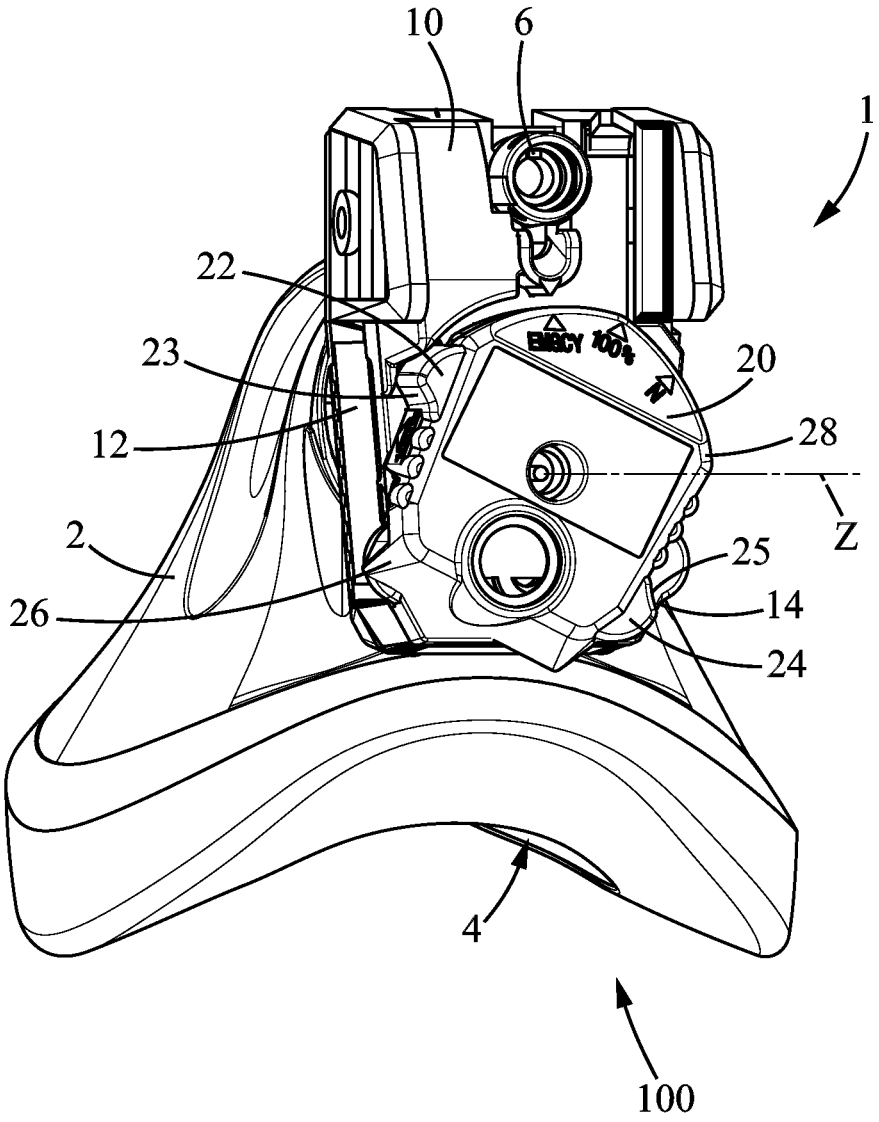
FIG. 2A, FIG. 2B, and FIG. 2C illustrate the regulator assembly according to a first embodiment, respectively in a first position, a second position, and a third position, along the arrow referenced II in FIG. 1, FIG. 3A, FIG. 3B, and FIG. 3C illustrate the regulator assembly according to a second embodiment, respectively in the first position, the second position, and the third position, along the arrow referenced III in FIG. 1, FIG. 4A, FIG. 4B, and FIG. 4C illustrate the regulator assembly according to a third embodiment, respectively in the first position, the second position, and the third position, along the arrow referenced IV in FIG. 1.
Figure 2B:
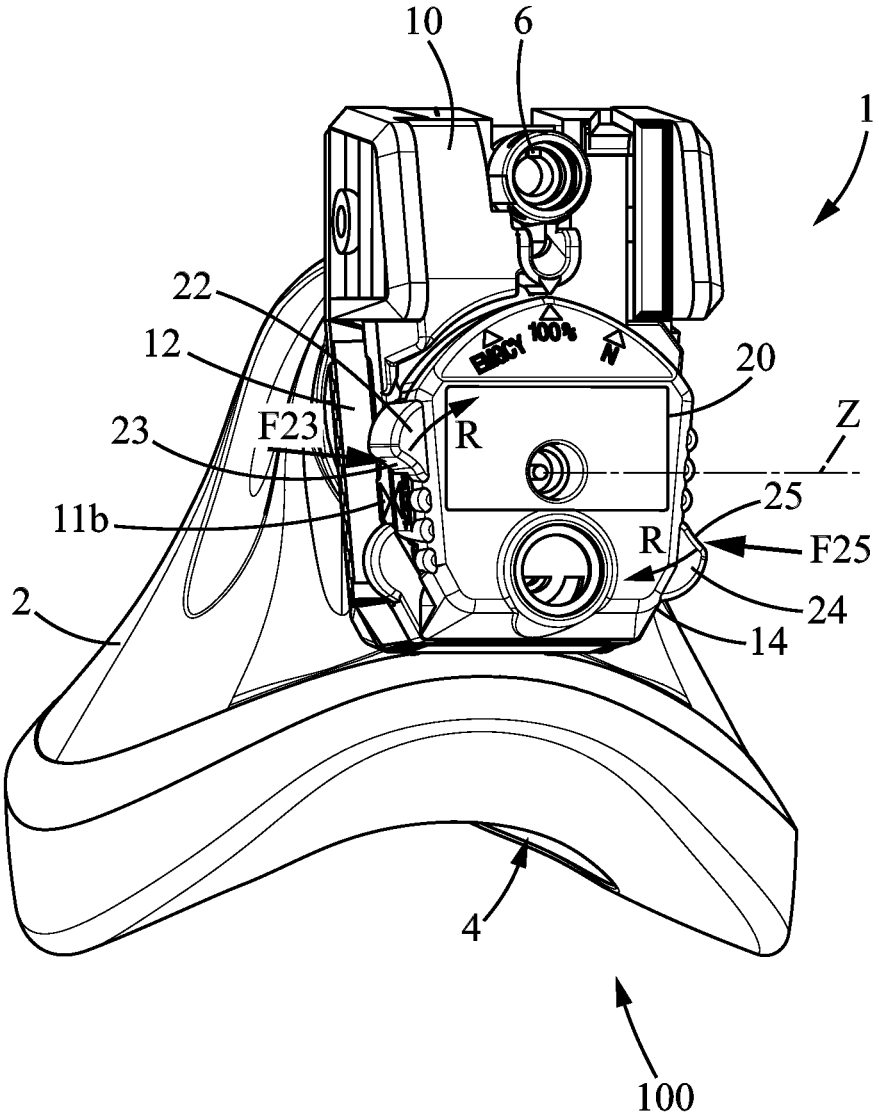
Figure 2C:
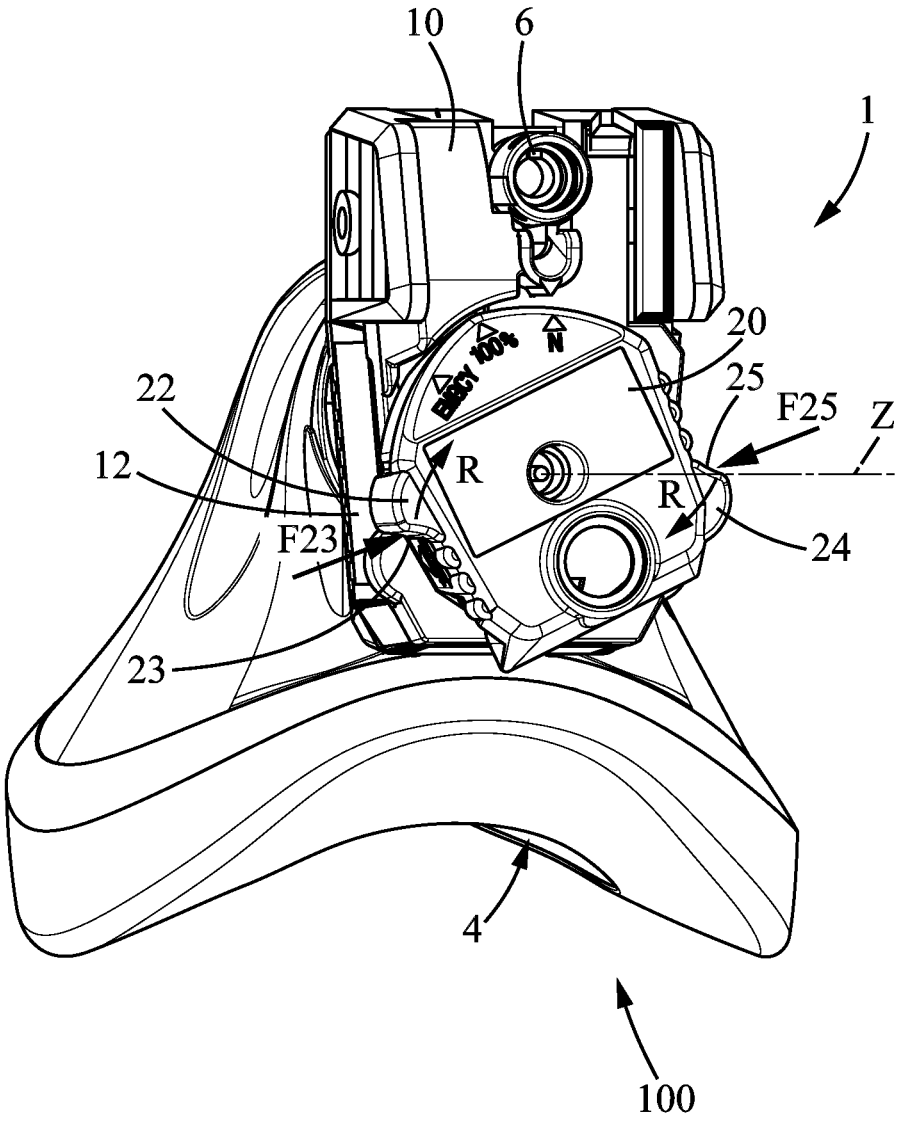
Figure 3A:
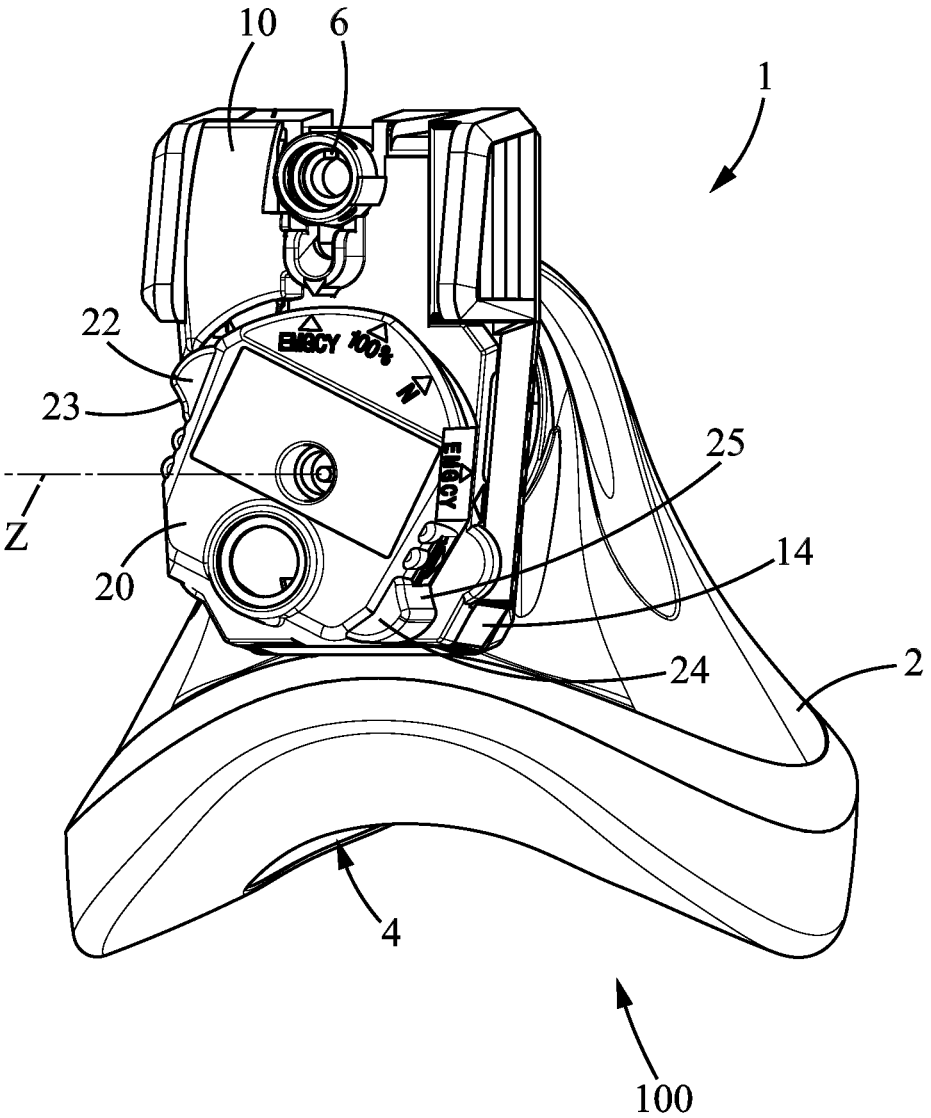
Figure 3B:
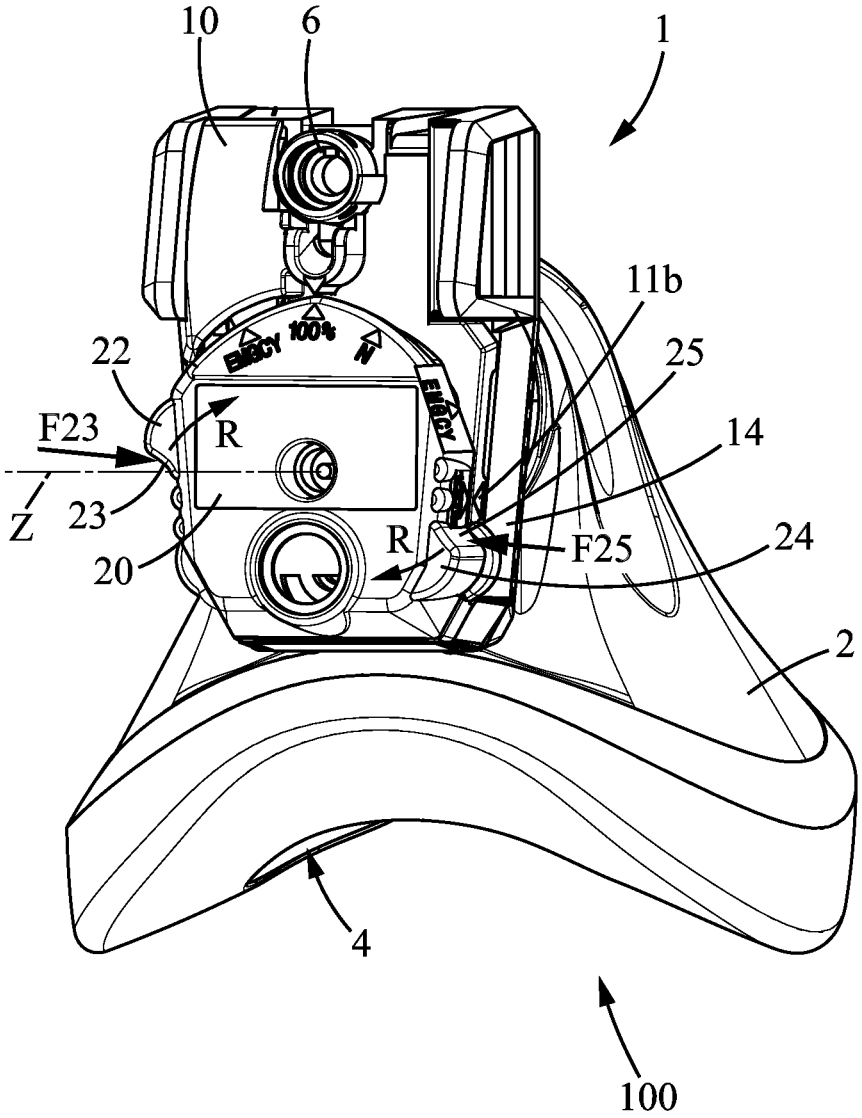
Figure 3C:
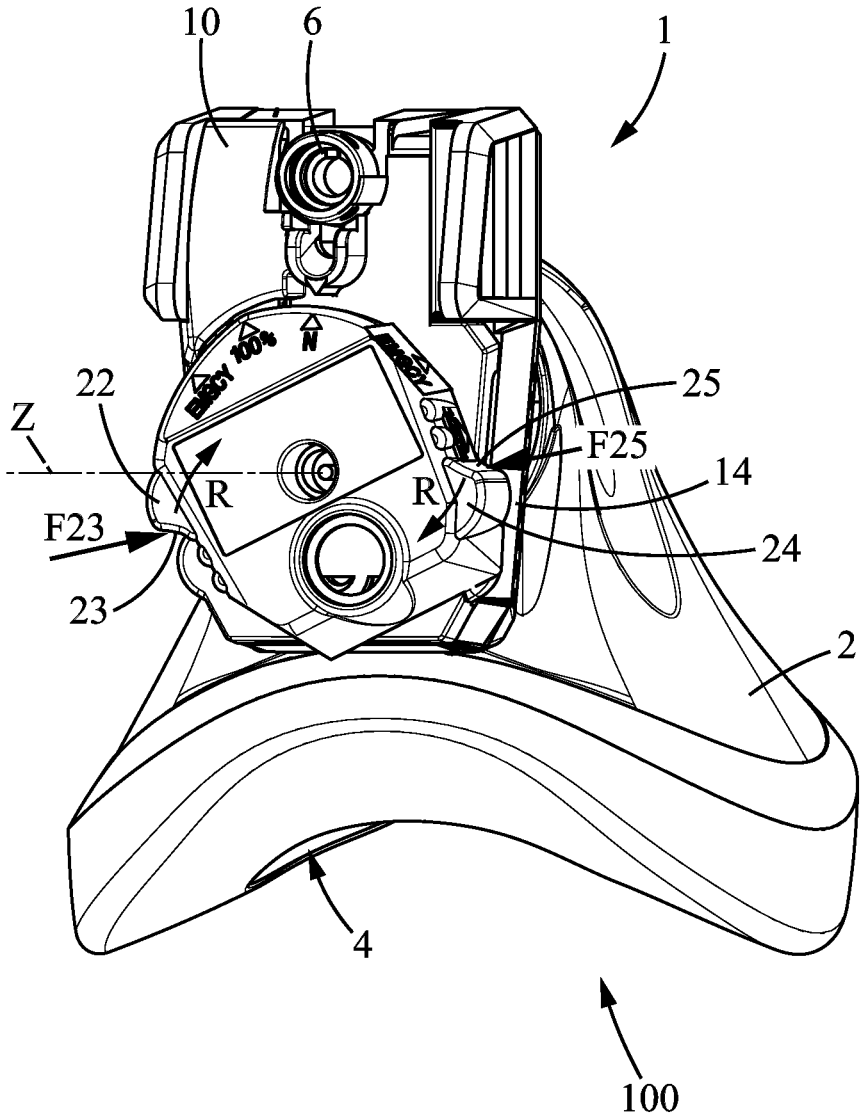
Figure 4A:
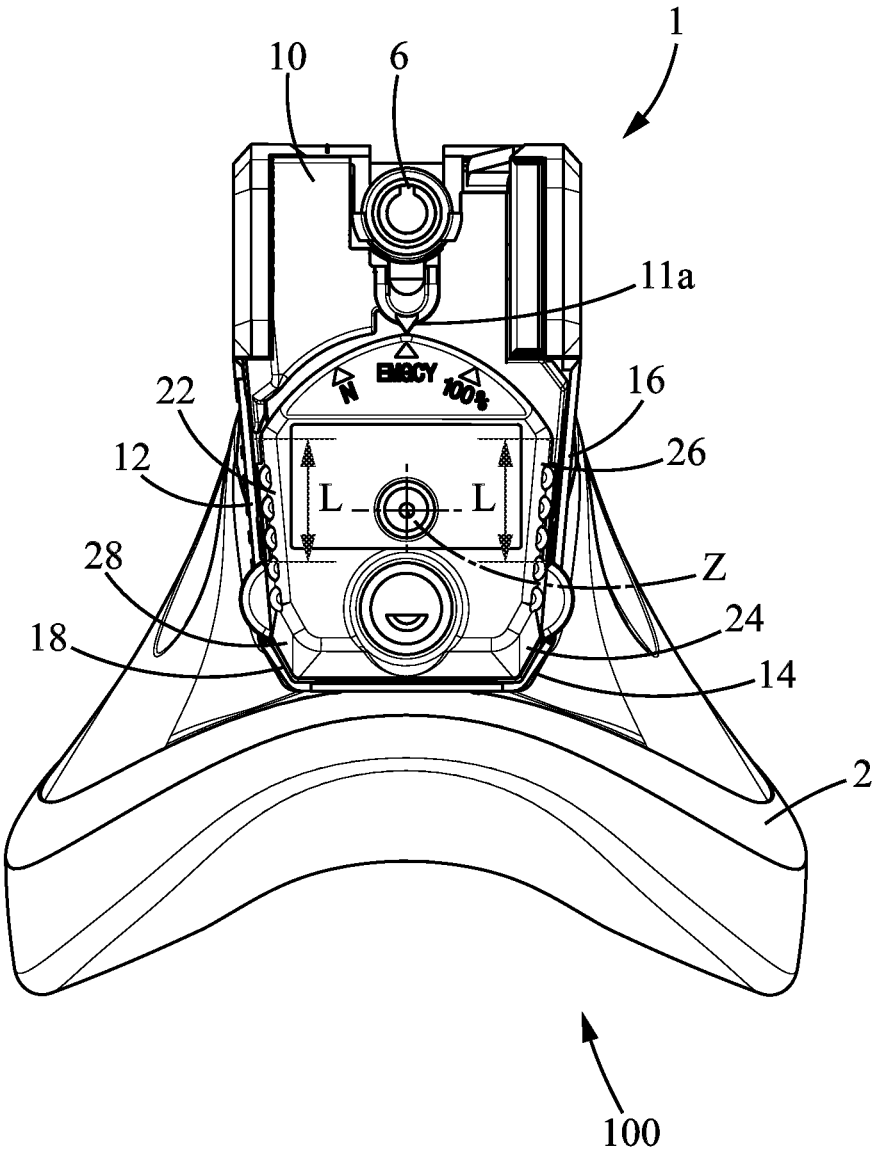

The mode selection knob 20 has a first position shown in FIGS. 2A, 3A, 4A which tells the regulator to operate in the first mode. The mode selection knob 20 has a second position shown in FIGS. 1, 2B, 3B, 4B which tells the regulator to operate in the second mode. The mode selection knob 20 has a third position shown in FIGS. 2C, 3C, 4C which tells the regulator to operate in the third mode.

The mode selection knob 20 is mounted so as to rotate about an axis of rotation Z. In the embodiment illustrated, the axis of rotation Z extends substantially vertically when the user holds his head upright, so that the mode selection knob 20 lies beneath the support 10. Of course, the mode selection knob 20 could be placed differently, in particular on the front of the support 10 and/or with an axis of rotation extending substantially horizontally. Alternatively, the mode selection knob could move translationally rather than pivoting. In a known manner, the three positions of the mode selection knob are discrete positions physically expressed by notches.

The mode selection knob 20 has a bottom and a peripheral edge. The labels EMGCY, 100%, and N are provided on the bottom and on two laterally opposed locations on the peripheral edge of the mode selection knob 20 in the embodiments illustrated. Three position indicators, an indicator 11*a* on the bottom and two side indicators 11*b*, 11*c* are optionally provided on the support 10 in order to indicate the mode selection position 20 and therefore the selected operating mode of the regulator. In particular, the side indicators 11*b* and 11*c* allow a person next to the user to see the selected operating mode of the regulator. Cross-verification between pilot and co-pilot in particular is thus easily accomplished.

The mode selection knob 20 has a first protruding portion 22 and a second protruding portion 24 which are diametrically opposed with respect to the axis of rotation Z.

Figure 4B:
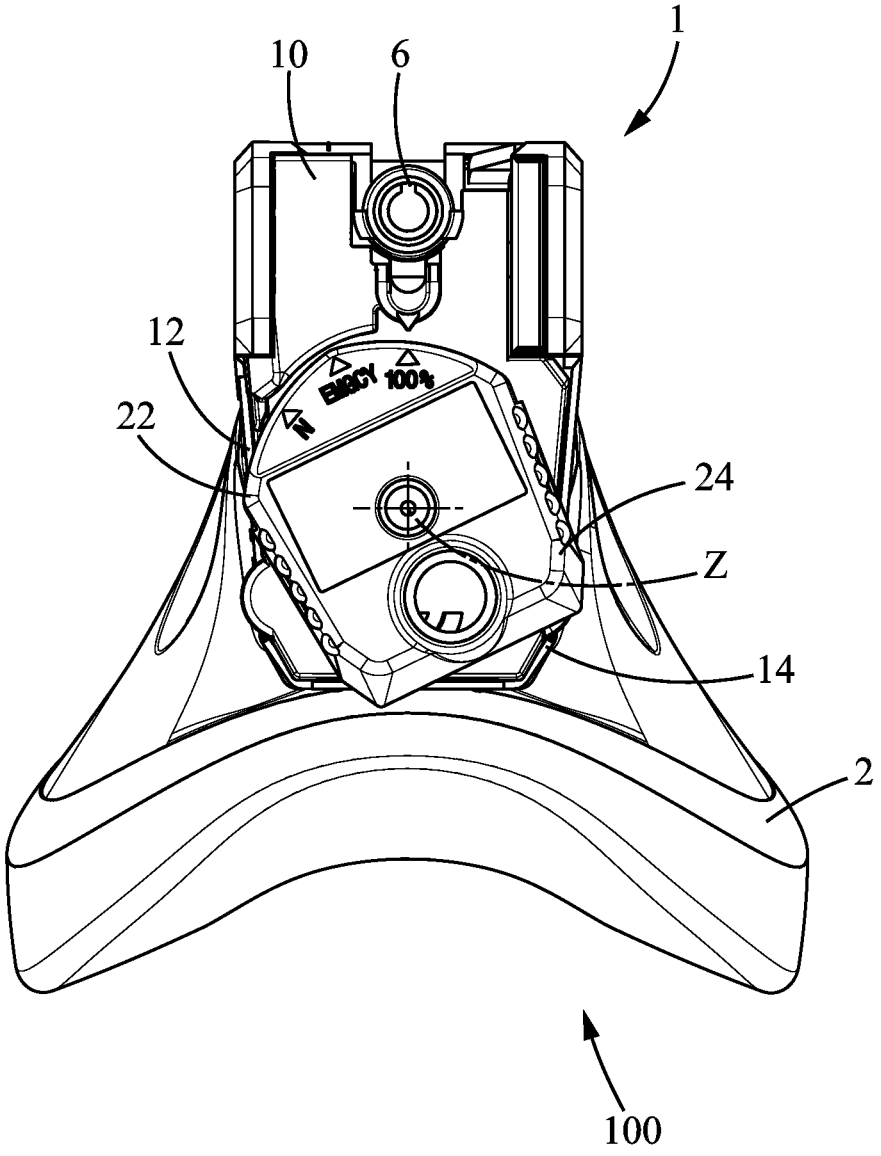

As illustrated in FIGS. 2B, 3B, and 4B, in the second position 100% of the mode selection knob 20, the first protruding portion 22 protrudes radially to the axis of rotation Z, beyond a first adjacent area 12 of the support 10 which is offset from the first protruding portion 22 in the direction of the axis of rotation Z and in immediate proximity to the mode selection knob 20.

When the first protruding portion 22 is pressed as explained below, the mode selection knob 20 is moved to the first position EMGCY, the first protruding portion 22 approaching the first adjacent area 12, in a direction perpendicular to the axis of rotation Z.

In the first position EMGCY of the mode selection knob 20, illustrated in FIGS. 2A, 2B, and 2C, the first protruding portion 22 of the mode selection knob is flush with the first adjacent area 12 of the support 10. In particular, at least a portion of the first protruding portion 22 lies as an extension of the first adjacent area 12 of the support 10, so that the user can simultaneously touch with one finger the first protruding portion 22 of the mode selection knob 20 and the first adjacent area 12 of the support 10, which will give the user a tactile indication that the first mode of the regulator has been selected.

In the first embodiment, illustrated in FIGS. 2A, 2B, and 2C, and in the second embodiment, illustrated in FIGS. 3A, 3B, and 3C, the first protruding portion 22 has a first support surface 23 extending substantially radially to the axis of rotation Z and the second protruding portion 24 has a second support surface 25 extending substantially radially to the axis of rotation Z. The first support surface 23 and the second support surface 25 are designed so that one receives the thumb and the other preferably the index finger of the user.

As shown in FIGS. 2B, 2C, 3B, and 3C, a pinching movement by the user applies forces $F_{23}$, $F_{25}$ directed towards one another, respectively on the first support surface 23 and on the second support surface 25 of the mode selection knob, which tends to rotate it toward the first position EMGCY as indicated by the arrows R.

This movement is advantageously favored by the concave shape of the first support surface 23 and second support surface 25 perpendicular to (in other words in a perpendicular plane) the direction of the axis of rotation Z. In addition, this movement is advantageously favored by the fact that the user's fingers can respectively slide on the first support surface 23 and second support surface 25 as the fingers move closer together. To this end, perpendicular to (in other words in a perpendicular plane) the direction of the axis of rotation Z, the first support surface 24 and second support surface 25 are smooth and/or have a low coefficient of friction. However, there could be ribs extending radially to the direction of the axis of rotation Z or any other means preventing the fingers from slipping on the first support surface 24 and/or second support surface 25 in the direction of the axis of rotation Z without this being detrimental to the implementation of the invention.

Also, and without this being necessarily related to what has been indicated in relation to the shape of the first support surface 23 and second support surface 25, in the second position 100% of the mode selection knob 20, the second protruding portion 24 of the mode selection knob 20 is flush with a second adjacent area 14 of the support 10 which substantially lies as an extension of the second protruding portion 24, in the direction of the axis of rotation Z.

As shown in FIGS. 2C and 3C, in the third position N of the mode selection knob 20, the first protruding portion 22 and second protruding portion 24 respectively protrude relative to the first adjacent area 12 and the second adjacent area 14, radially to the axis of rotation Z.

When the user presses on the first protruding portion 22 and/or second protruding portion 24, preferably on the first support surface 23 and second support surface 25 by pinching as described above, the forces $F_{23}$, $F_{25}$ applied on the mode selection knob 20 rotate the mode selection knob 20 toward the first position EMGCY, as indicated by the arrows R.

In the second embodiment and third embodiment, the second position 100% is located between the third position N and the first position EMGCY, and when the mode selection knob 20 is moved from the third position N to the first position EMGCY, the first protruding portion 22, in particular the first support surface 23, is moved toward the first adjacent area 12, and the second protruding portion 24, in particular the second support surface 25, is moved toward the second adjacent area 14.

As indicated above, in the second position 100% of the mode selection knob 20, the second protruding portion 24, in particular the second support surface 25, being flush with the second adjacent area 14, the user simultaneously touches with one finger the second protruding portion 24 of the mode selection knob 20 and the second adjacent area 14 of the support 10, which will give a tactile indication that he or she has selected the second mode of the regulator. He or she may then continue the rotational movement of the mode selection knob 20 toward the first position EMGCY, as described above, or may stop depending on what mode is desired, based solely on tactile indications.

As illustrated in particular in FIGS. 2A and 3A, the second embodiment differs from the first embodiment in that in the first position EMGCY of the mode selection knob 20, the mode selection knob 20 has no portion that protrudes radially to the axis of rotation Z beyond an adjacent area of the support that is in immediate proximity and is offset in the direction of the axis of rotation Z. The first position EMGCY of the mode selection knob 20 is therefore particularly characteristic for the user.

In the third embodiment, as illustrated in FIG. 4B, in the second position 100% of the mode selection knob 20, the second protruding portion 24 protrudes, radially to the axis of rotation Z, beyond a second adjacent area 14 of the support 10 which is offset from the second protruding portion 24 in the direction of the axis of rotation Z and in immediate proximity to the mode selection knob 20.

When the mode selection knob is in the second position 100% and the user presses on the first protruding portion 22 and/or second protruding portion 24 to rotate the mode selection knob 20, the second position 100% being an extreme position, the user can only rotate the mode selection knob 20 in one direction (clockwise in FIG. 4B), toward the first position EMGCY.

When moving the mode selection knob 20 from the second position 100% toward the first position EMGCY, the first protruding portion 22 is moved toward the first adjacent area 12 and the second protruding portion 24 is moved toward the second adjacent area 14.

In the first position EMGCY, as illustrated in FIG. 4A, the first protruding portion 22 is flush with the first adjacent area 12 in the direction of the axis of rotation Z and the first protruding portion 22 lies as an extension of the first adjacent area 12 in the direction of the axis of rotation Z, for a length L of at least 1 cm, preferably at least 2 cm, perpendicular to the direction of the axis of rotation Z. Similarly, the second protruding portion 24 is flush with the second adjacent area 14 in the direction of the axis of rotation Z, and the second protruding portion 24 lies as an extension of the second adjacent area 14 in the direction of the axis of rotation Z.

Figure 4C:
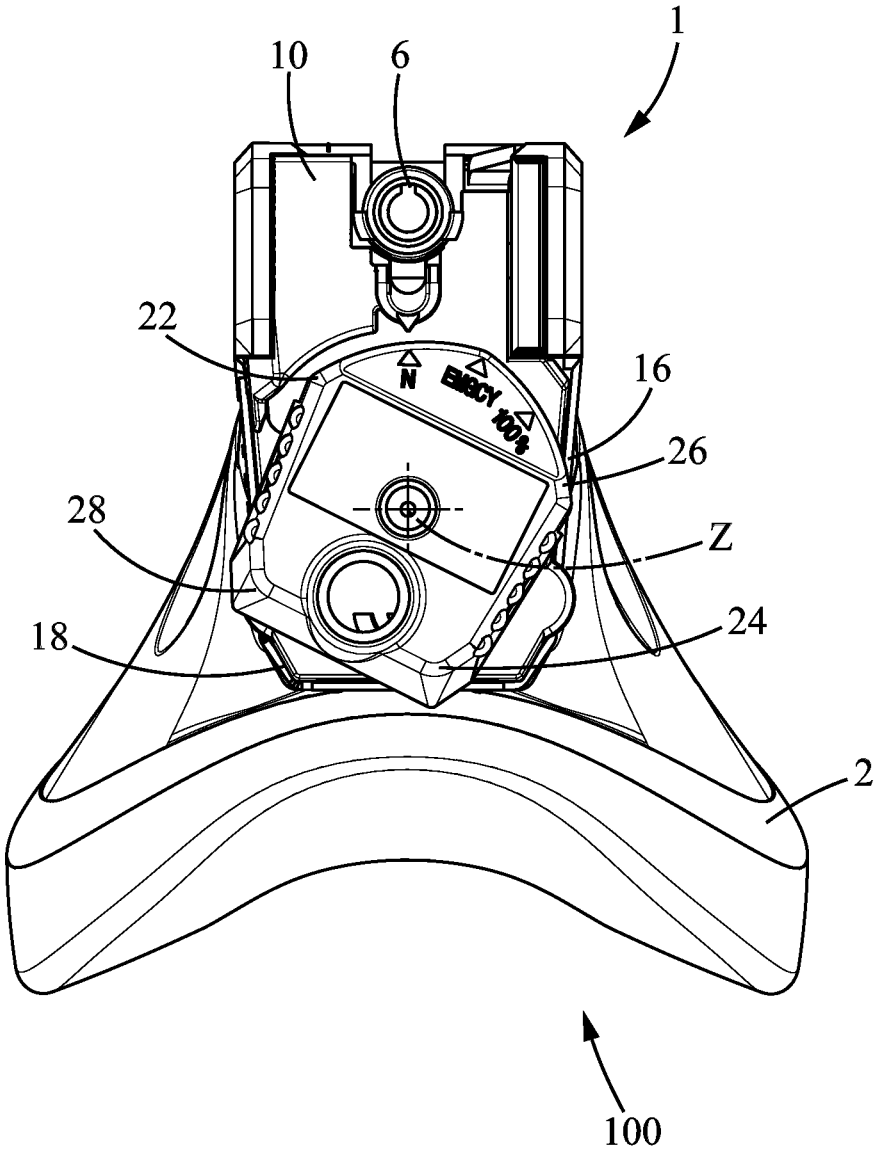

Similarly, as illustrated in FIG. 4C, according to the third embodiment, in the third position N of the mode selection knob 20 a first secondary protruding portion 26 protrudes radially to the axis of rotation Z, beyond a first secondary adjacent area 16 of the support 10 which is offset from the first secondary protruding portion 26 in the direction of the axis of rotation Z and in immediate proximity to the mode selection knob 20.

In addition, a second secondary protruding portion 28 substantially diametrically opposed to the first secondary protruding portion 26 protrudes radially to the axis of rotation Z, beyond a second secondary adjacent area 18 of the support 10 which is offset from the second secondary protruding portion 28 in the direction of the axis of rotation Z and in immediate proximity to the mode selection knob 20.

When the mode selection knob is in the third position N and the user presses on the first secondary protruding portion 26 and/or the second secondary protruding portion 28 to rotate the mode selection knob 20, the third position N being an extreme position, the user can only rotate the mode selection knob 20 in one direction (counterclockwise in FIG. 4C) toward the first position EMGCY.

In the third embodiment, the third position N is opposite the second position 100%. The first position EMGCY is located between the second position 100% and the third position N.

When moving the mode selection knob 20 from the third position N to the first position EMGCY, the first secondary protruding portion 26 is moved toward the first secondary adjacent area 16 and the second secondary protruding portion 28 is moved toward the second secondary adjacent area 18.

In the first position EMGCY, as illustrated in FIG. 4A, the first secondary protruding portion 26 is flush with the first secondary adjacent area 16 in the direction of the axis of rotation Z, and the first secondary protruding portion 26 lies as an extension of the first secondary adjacent area 16 in the direction of the axis of rotation Z, for a length L of at least 1 cm, preferably at least 2 cm perpendicular to the direction of the axis of rotation Z. Similarly, the second secondary protruding portion 28 is flush with the second secondary adjacent area 18 in the direction of the axis of rotation Z and the second secondary protruding portion 28 lies as an extension of the second secondary adjacent area 18 in the direction of the axis of rotation Z.

The invention is of course not limited to the embodiment (s) described by way of illustration, not limitation. Thus, except where it clearly falls outside the description, it would be possible to modify each of the three embodiments to impart some or all of the characteristics of one of the other embodiments.

In addition, instead of being movable in rotation, the mode selection knob could be movable in translation.

I claim:

1. A regulator assembly for a breathing mask to be used by an aircraft crew member, comprising:

a casing forming a support, a mode selection knob mounted on the support, the mode selection knob being rotatable about an axis of rotation between at least a first position and a second position, a regulator intended to be supplied by a source of breathing gas and adapted to supply breathing gas to a breathing cavity in at least the following two operating modes:

(1) when the mode selection knob is in said first position, the regulator supplies gas to the breathing cavity as long as the pressure in the breathing cavity is not greater than a first pressure relative to ambient pressure, and (2) when the mode selection knob is in said second position, the regulator supplies gas to the breathing cavity as long as the pressure in the breathing cavity is not greater than a second pressure relative to ambient pressure, the first pressure being greater than the second pressure, and wherein the mode selection knob comprises at least first and second protruding portions diametrically opposed relative to the axis of rotation, the first and second protruding portions respectively having a first support surface and a second support surface, each extending substantially radially to the axis of rotation and such that a force exerted on one or the other of the first support surface and second support surface in the direction of the axis of rotation rotates the mode selection knob from the second position to the first position, and wherein the first support surface and second support surface are each concave.

2. The regulator assembly according to claim 1 wherein the first support surface and second support surface are each smooth.

3. The regulator assembly according to claim 1 wherein the support has an adjacent area offset from at least one of the first and second protruding portions in the direction of the axis of rotation and in immediate proximity to the mode selection knob, and in the second position of the mode selection knob, at least one of the first and second protruding portions protrudes, relative to the adjacent area of the support, radially to the axis of rotation, and when the mode selection knob moves from the second position to the first position, at least one of the first and second protruding portions is moved toward said adjacent area of the support.

4. The regulator assembly according to claim 3 wherein at least one of the first and second protruding portions is flush with the adjacent area of the support when the mode selection knob is in the first position.

5. The regulator assembly according to claim 4 wherein, when the mode selection knob is in the first position, at least one protruding portion lies substantially as an extension of the adjacent area of the support perpendicular to the axis of rotation.

6. The regulator assembly according to claim 1 wherein the mode selection knob comprises a third position, the second position being located between the third position and the first position.

7. The regulator assembly according to claim 6 wherein:

(1) the support has a second adjacent area offset from the second protruding portion in the direction of the axis of rotation and in immediate proximity to the mode selection knob, (2) in the third position of the mode selection knob, the second protruding portion protrudes relative to the second adjacent area of the support, radially to the axis of rotation, and (3) when the mode selection knob moves from the third position to the second position, the second protruding portion of the mode selection knob is moved toward said second adjacent area of the support.

8. The regulator assembly according to claim 7 wherein, in the second position of the mode selection knob, the second protruding portion of the mode selection knob is flush with the second adjacent area of the support.

9. A regulator assembly for a breathing mask to be used by a crewmember of an aircraft, comprising:

(a) a support;

(b) a mode selection knob (i) mounted on the support, (ii) rotatable about a rotation axis between at least a first position and a second position, and (iii) comprising at least first and second protrusions diametrically opposed relative to the axis of rotation and respectively including a first support surface and a second support surface, with each of the first and second support surfaces (A) extending substantially radially to the rotation axis and (B) structured so as to receive a finger of the crewmember such that, when a force directed toward the rotation axis is applied to either or both of the first support surface or the second support surface by at least one finger of the crewmember, the mode selection knob is biased to the first position; and (c) a regulator configured to supply breathing gas to a breathing cavity of the breathing mask in at least first and second modes, a first mode operating when the mode selection knob is in the first position and a second mode operating when the mode selection knob is in the second position.

10. A regulator assembly according to claim 9 in which, in operation of the first mode, the regulator supplies undiluted breathing gas to the breathing cavity of the breathing mask.

11. A regulator assembly according to claim 10 in which:

in operation of the first mode, the regulator supplies undiluted breathing gas to the breathing cavity as long as the pressure in the breathing cavity is not greater than a first pressure relative to ambient pressure, and in operation of the second mode, the regulator supplies gas to the breathing cavity as long as the pressure in the breathing cavity is not greater than a second pressure relative to ambient pressure, the first pressure being greater than the second pressure.

12. A regulator assembly according to claim 9 in which the first support surface is smooth.

13. The regulator assembly according to claim 9 wherein the support has an adjacent area offset from the first protrusion in the direction of the axis of rotation and in immediate proximity to the mode selection knob, and in the second position of the mode selection knob, the first protrusion protrudes, relative to the adjacent area of the support, radially to the axis of rotation, and when the mode selection knob moves from the second position to the first position, the first protrusion is moved toward said adjacent area of the support.

14. The regulator assembly according to claim 13 wherein the first protrusion is flush with the adjacent area of the support when the mode selection knob is in the first position.

15. The regulator assembly according to claim 14 wherein, when the mode selection knob is in the first position, the first protrusion lies substantially as an extension of the adjacent area of the support perpendicular to the axis of rotation.

16. The regulator assembly according to claim 9 wherein the mode selection knob comprises a third position, the second position being located between the third position and the first position.

17. A regulator assembly for a breathing mask to be used by a crewmember of an aircraft, comprising:

(a) a support;

(b) a mode selection knob (i) mounted on the support, (ii) rotatable about a rotation axis between at least a first position and a second position, and (iii) comprising at least one protrusion including a support surface (A) extending substantially radially to the rotation axis and (B) structured so as to receive a finger of the crewmember such that, when a force directed toward the rotation axis is applied to the mode selection knob by the finger, the mode selection knob is biased to the first position; and (c) a regulator configured to supply breathing gas to a breathing cavity of the breathing mask in at least first and second modes, a first mode operating when the mode selection knob is in the first position and a second mode operating when the mode selection knob is in the second position; and in which the support surface is concave.

* * * * *